United States Patent [19]

McCaffrey

[11] Patent Number: 4,476,013

[45] Date of Patent: Oct. 9, 1984

[54] FROTH FLOTATION

[75] Inventor: David J. A. McCaffrey, Cheltenham, England

[73] Assignee: Coal Industry (Patents) Limited, London, England

[21] Appl. No.: 447,714

[22] Filed: Dec. 7, 1982

[30] Foreign Application Priority Data

Dec. 18, 1981 [GB] United Kingdom ..... 8138288

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS 4,416,769 11/1983 McCaffrey et al. ..... 209/166

*Primary Examiner*—Bernard Nozick

*Attorney, Agent, or Firm*—Stevens, Davis, Miller & Mosher

[57] ABSTRACT

In the froth flotation of coal, especially coking coal, improved results are observed when using as a collector an oil distillate cut within the range 80° to 250° C., containing less than 20% by weight of naphthenes, less than 20% by weight of aromatic content and more than 60% by weight of n-alkanes and branched-alkanes. Preferably, the collector is used with a polyglycol ether "frother".

5 Claims, 2 Drawing Figures

FROTH FLOTATION

Figure 1:
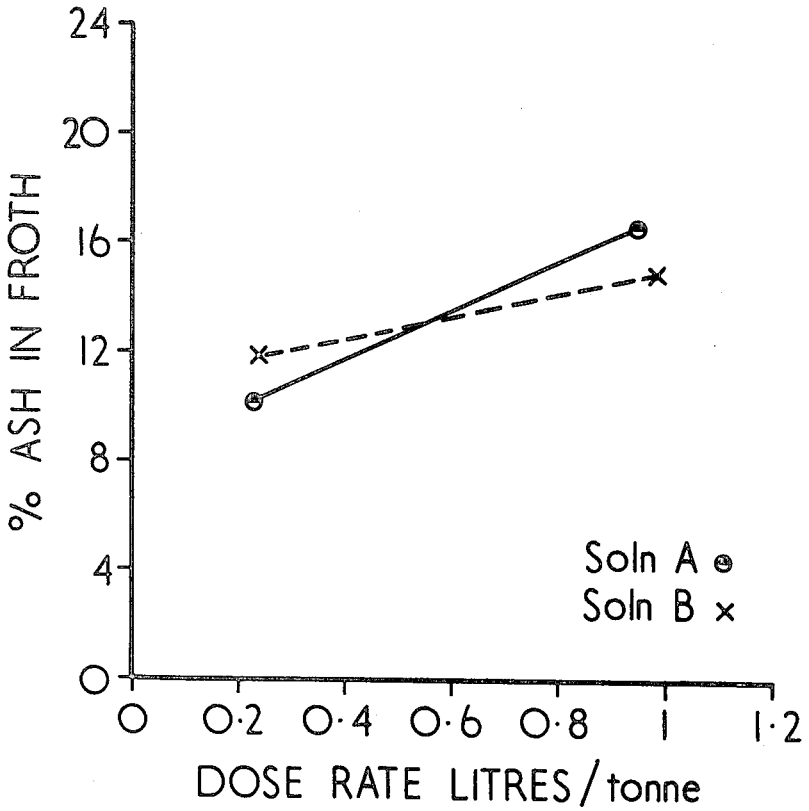

This invention concerns improvements in froth flotation, especially the froth flotation of coking coal.

The techniques of froth flotation of minerals is well known in the art, and is described in the literature for example "Handbook of Mineral Dressing" by A. F. Taggart, John Wiley & Sons, 1954, Section 12. In the coal industry, froth flotation is used to treat suspensions of coal fines which are difficult to treat in any other way. Conventional techniques involve the addition of a froth flotation oil to the suspension of the mineral and the passage of air through the suspension to creat bubbles which carry the fine mineral to the surface to form a froth rich in minerals, the froth then being removed and the mineral recovered therefrom. The froth foltation oil may be a single compound or mixture of compounds of similar characteristics, but it is modern good practice, at least in the coal industry, to use a combination of a "frother" and a "collector". The "frothers" usable are of classes broadly known in the art, and the "collector" is usually a hydrocarbon oil of which distillate oils such as kerosene, industrial diesel fuel and furnace oil are the most widely used, especially kerosene. It has been suggested that good collectors for fine coal suspensions are those having a high proportion of aromatic hydrocarbons because of their affinity for the coal which has a polynuclear aromatic structure.

In our co-pending British Patent Application, No. 80/27412, we have disclosed that certain residual oils, namely a residual oil which is predominantly paraffinic and has a cut point of at least 190° C. at atmospheric pressure, is a useful collector for froth flotation.

It has now been discovered that selected distillate oils offer advantages in the froth flotation of coal, particularly of coking coal.

The present invention therefore provides the use of an oil distillate cut within the range 80° to 250° C., preferably a 150° to 190° C. cut, which has less than 20% by weight of cycloalkanes (naphthenes), less than 20% by weight aromatic content and more than 60% by weight total content of n-alkanes and branched alkanes as a collector in the froth flotation of minerals. The invention also provides a froth flotation mixture comprising the defined oil distillate in association with a "frother".

The invention further provides a method of treating minerals in a froth flotation cell comprising the operation of the cell using a collector which is the defined oil distillate.

The oil distillate preferably contains at least 74% by weight total content of n- an branched-alkanes. Preferably, the oil distillate contains less than 11% by weight of naphthenes and/or less than 15% by weight of aromatics. Other components than aromatics, naphthenes and n- and branched-chain alkanes may be present provided that they do not interfere with the effectiveness of the collector in use. The oil distillate is suitably a petroleum gas condensate fraction, and good results have been achieved with a North Sea gas condensate fraction. Distillates from crude oil have also been found suitable. An example of a preferred oil distillate is a white spirit cut from a gas condensate; if necessary the content of aromatics can be adjusted by conventional methods such as solvent extraction.

The collector of the invention is used in conventional manner with a "frother". A preferred "frother" is a polyglycol ether, and these are commercially available; other conventional "frothers" may, however, be used. The "frother" is suitably used with the collector in an amount of up to 40% by weight, suitably 10 to 20% by weight, especially about 15% by weight. The collector and frother may be combined before use and supplied to the froth flotation cell as a mixture, but they may be fed separately to the cell if desired.

The invention offers particular advantages over other collectors in the treatment of coking coals, but the invention may be used also in the treatment of other coals or other minerals which require an oily collector, such as talc or illmonite. The particular benefits in relation to coking coals will be illustrated in the following Example of the invention.

EXAMPLE

Froth flotation solution A. A commercially available 150° to 190° C. cut of a North Sea gas condensate having 14.7% by weight of aromatics, 74.5% by weight total of n-alkanes and branched-alkanes, 10.8% by weight of naphthenes, is admixed with 15% by weight of a commercial polyglycol ether "frother".

Froth flotation solution B. A commercial froth flotation solution containing 15% of the same "frother" as solution A in admixture with a high aromatic kerosene hydrocarbon collector, being an approximately 70° to 230° C. cut and containing 20% of aromatics, 26% naphthenes and 54% of n- and branched-chain alkanes.

The froth flotation solutions A and B were tested in a laboratory froth flotation cell at a number of does rates ranging from 0.2 to 2 liter of solution per tonne of coal (on a dry basis) charged to the cell in the form of a slurry containing nominally 10% solids content. The coal slurry was the normal coal slurry from Manton Colliery in the National Coal Board's South Yorkshire Area, which produces a prime coking coal; this slurry is normally treated in a coal preparation plant by froth flotation solution B.

A study was made of the ash-in-froth from the tests in the laboratory cell. Ash-in-froth is the percentage of ash in the total solids recovered from the froth; since the froth is intended to collect fine coal particles from the slurry, and the recovered coal is added to saleable coal production, clearly a low ash-in-froth is desirable particularly for coking coals as this affects the ash content and the value of the final coal product. The ash-in-froth was plotted against dose rate of each of the solutions, and is shown in FIG. 1. It can be seen that for the coking coal tested, the froth flotation solution A according to the invention gave a reduction of two percentage points of ash-in-froth at the lowest dosage tested, compared to the commercial solution B.

Figure 2:
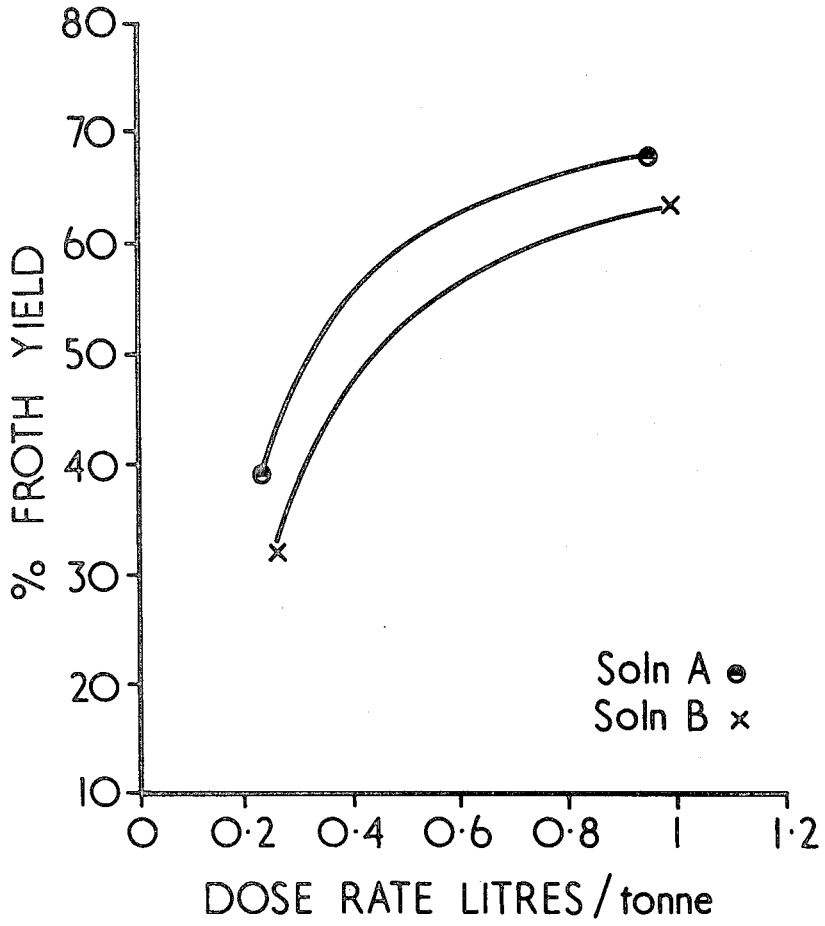

A further study was made of the froth yield, that is the percentage of dried froth against solids content of the initial charge of coal slurry, also against dosage rate, and the results plotted on the graph of FIG. 2. It can be seen that the solution A according to the invention gives about eight percentage points greater yield over the whole range tested.

The ash-in-tailings, that is the percentage ash in the solids residue from the frother flotation cell, is of more importance for power station coals where the recovery of coal is of utmost importance, but was also measured in the present series of tests. In the Manton coal preparation plant, the results normally achieved were 65 to 75% by weight of ash-in-tailings, whereas the ash-in-tailings in the test cell using solution A ranged from 80 to 90% by weight.

It can be seen that the present invention provides economically significant improvements in the froth flotation treatment of coking coals compared to a good commercial froth flotation solution.

We claim:

1. In the method of froth flotation of coking coal using a collector, the improvement comprising the use as the collector an oil distillate cut within the range 150° to 190° C., which distillate contains less than 20% by weight of naphthenes, less than 20% by weight of aromatic content and more than 60% by weight total content of n-alkanes and branched-alkanes.

2. The method of claim 1, wherein the oil distillate contains less than 15% by weight of aromatic content, less than 11% by weight of naphthenes and more than 74% by weight of alkanes.

3. The method of claim 1, wherein the oil distillate is a fraction of a natural gas condensate or of a crude oil.

4. The method of claim 1, wherein the oil distillate is used together with 10 to 20% by weight of a "frother".

5. The method of claim 4, wherein the "frother" is a polyglycol ether.

* * * * *